US006579133B1

(12) United States Patent
Harris

(10) Patent No.: US 6,579,133 B1
(45) Date of Patent: Jun. 17, 2003

(54) BOAT POSITIONING APPARATUS AND SYSTEM

(76) Inventor: Bill Harris, 3301 Imperial Valley Dr., Little Rock, AR (US) 72212

( * ) Notice: Subject to any disclaimer, the term of this patent is extended or adjusted under 35 U.S.C. 154(b) by 0 days.

(21) Appl. No.: 10/164,382

(22) Filed: Jun. 6, 2002

(51) Int. Cl.[7] ..... B63H 25/46

(52) U.S. Cl. ..... 440/7; 114/151; 440/6; 440/40

(58) Field of Search ..... 440/6, 7, 40, 900, 440/43; 114/151

(56) References Cited

U.S. PATENT DOCUMENTS

| | | | | |
|---|---|---|---|---|
| 42,642 | A | | 5/1864 | Covingon |
| 3,143,972 | A | | 8/1964 | Smith et al. |
| 3,251,330 | A | * | 5/1966 | Honegger ..... 114/147 |
| 3,596,625 | A | * | 8/1971 | Guenther ..... 440/6 |
| 4,056,073 | A | | 11/1977 | Dashew et al. |
| 4,082,068 | A | | 4/1978 | Hale |
| 4,208,978 | A | | 6/1980 | Eller |
| 4,214,544 | A | | 7/1980 | Dashew et al. |
| 4,223,625 | A | | 9/1980 | Puretic |
| 4,260,011 | A | | 4/1981 | Brown |
| 4,265,192 | A | | 5/1981 | Dunn |
| 4,312,304 | A | | 1/1982 | Tyner |
| 4,423,696 | A | | 1/1984 | Aker |
| 4,455,960 | A | | 6/1984 | Aker |
| 4,487,149 | A | | 12/1984 | Morris |
| 4,531,920 | A | | 7/1985 | Stricker |
| 4,545,332 | A | | 10/1985 | Suzuki et al. |
| 4,549,868 | A | | 10/1985 | Lolly |
| 4,732,104 | A | | 3/1988 | Roestenberg |
| 5,016,553 | A | * | 5/1991 | Spencer ..... 114/151 |
| 5,041,029 | A | | 8/1991 | Kulpa |
| 5,140,926 | A | | 8/1992 | Denston |
| 5,181,868 | A | | 1/1993 | Gabriel |
| 5,282,763 | A | | 2/1994 | Dixon |
| 5,289,793 | A | | 3/1994 | Aker |
| 5,491,636 | A | | 2/1996 | Robertson et al. |
| 5,509,372 | A | * | 4/1996 | Culotta ..... 114/315 |
| 5,522,335 | A | | 6/1996 | Veronesi et al. |
| 5,642,684 | A | | 7/1997 | Aker |
| 5,704,306 | A | | 1/1998 | Den Ouden |
| 5,896,022 | A | * | 4/1999 | Jacobs, Sr. ..... 320/103 |
| 6,142,841 | A | | 11/2000 | Alexander, Jr. et al. |
| 6,250,981 | B1 | | 6/2001 | Morikami |

* cited by examiner

*Primary Examiner*—Sherman Basinger
(74) *Attorney, Agent, or Firm*—Mark A. Rogers; Gary N. Speed

(57) ABSTRACT

A boat positioning apparatus and system are disclosed. The apparatus and system may include a boat having a hull, an outboard motor, and a thruster. The thruster has a housing that is secured to the transom to maintain a fixed position relative to the transom. The housing is disposed above a slip stream that occurs when the boat is on plane. A reversible electric motor is disposed in the housing, and a shaft passes through the housing, with propellers affixed to each end of the shaft. A switch, preferably a foot switch, is operably connected to the reversible electric motor. The reversible electric motor may be connected to the same battery used for the outboard motor. Hook and loop fasteners may be used to provide flexibility in positioning the switch in the boat. In an alternate embodiment, the boat positioning system is built into an outboard motor. In the alternate embodiment, a water intake line supplies water to a pump. One or more water discharge lines are operably connected to the pump, disposed to selectively discharge water from discharge openings in either the port or starboard side of the housing. A switch is operably connected to the water discharge line to selectively discharge water from either the discharge opening on the port side of the housing or the discharge opening on the starboard side of the housing.

20 Claims, 3 Drawing Sheets

BOAT POSITIONING APPARATUS AND SYSTEM

BACKGROUND OF THE INVENTION

This invention relates to a boat positioning system and, more particularly, to a freshwater recreational or tournament fishing boat positioning system.

Thirty years of bass fishing led to this invention. Bass fishermen, in particular, know that the person fishing from the back, or stern, of a boat is at a disadvantage. Common practice rules of two man tournaments typically mandate that positions be switched midway through the day so that both fishermen have equal opportunities. This rule recognizes that there is no acceptable way to control the lateral movement of the stern. Too much time is lost by both fishermen, but by the fisherman at the stern in particular, when only a front, or bow, mounted trolling motor is used to position the boat.

Some efforts have been made to provide more control in moving the stern of a boat port or starboard, but those efforts have not adequately addressed the needs of fishermen. Some of these systems have been designed for large, sea-going vessels with fixed screws, primarily for use during docking of these large vessels. Others have used elaborate hull designs. These designs have typically been costly and complex and have typically not taken into consideration the needs of recreational or competitive fishermen.

SUMMARY OF THE INVENTION

It is therefore an object of the present invention to provide a system and device that allows for easy positioning of a fishing boat, particularly of the stern of a fishing boat.

It is a further object of the present invention to provide a system and device of the above type that is easily installed, operated, and maintained.

It is a still further object of the present invention to provide a system and device of the above type that allows hands free or automatic position control.

It is a still further object of the present invention to provide a system and device of the above type that will not detract from the steering or handling of a boat, particularly when the boat is on plane.

It is a still further object of the present invention to provide a system and device of the above type that uses the boat's existing battery system.

It is a still further object of the present invention to provide a system and device of the above type that allows flexibility in positioning of the controls.

It is a still further object of the present invention to provide a system and device of the above type that provides these features and advantages built into an outboard motor.

Toward the fulfillment of these and other objects and advantages, the boat positioning system of the present invention comprises a boat having a hull, an outboard motor, and a thruster. The thruster has a housing that is secured to the transom to maintain a fixed position relative to the transom. The housing is disposed above a slip stream that occurs when the boat is on plane. A reversible electric motor is disposed in the housing, and a shaft passes through the housing, with propellers affixed to each end of the shaft. A switch, preferably a foot switch, is operably connected to the reversible electric motor. The reversible electric motor may be connected to the same battery used for the trolling motor. Hook and loop fasteners may be used to provide flexibility in positioning the switch in the boat. In an alternate embodiment, the boat positioning system is built into an outboard motor. In the alternate embodiment, a water intake line supplies water to a pump. First and second water discharge lines are operably connected to the pump, disposed to discharge water from the port and starboard sides, respectively, of the outboard motor housing. A switch is operably connected to selectively discharge water from either the first or second water discharge line.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings, wherein.

DETAILED DESCRIPTION OF THE PREFERRED EMBODIMENT

Figure 1:
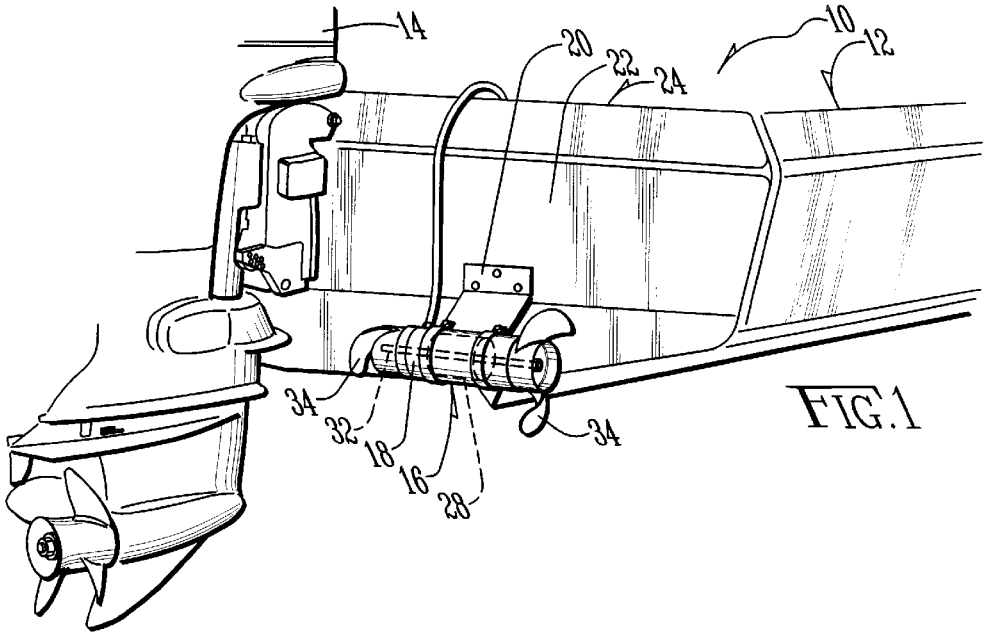
FIG. 1 is a rear elevation view of a system of the present invention.

Referring to FIG. 1, the reference numeral 10 refers in general to a boat equipped to practice the present invention. The boat 10 has a hull 12, an outboard motor 14, and a thruster 16.

The thruster 16 has a cylindrical, watertight housing 18, with double seals and ball bearings at each end. A bracket 20 secures the housing 18 to the transom 22 of the boat 10 and maintains the housing 18 in a fixed position relative to the transom 22. The housing 18 is positioned on the transom 22 so that it is disposed above a slip stream that occurs when the boat 10 is on plane. Although shown on the starboard side 24, the thruster 16 may be positioned on the port side 26 or may be centered so long as its positioning does not interfere with operation of the outboard motor 14.

A reversible, DC electric motor 28 is scaled within the housing 18. The electric motor 28 is selected to use the existing battery system voltage, such as 12, 24, or 36 vdc. The electric motor 28 uses the same battery 30 used by the trolling motor or starter for the outboard motor 14, so no separate power supply is needed. The power demands of the electric motor 28 are relatively small, and the electric motor 28 is used for relatively short periods of time. The size and power of the motor may vary depending upon the size and weight of the boat. For example, for a small, light boat, like a 17.5 foot aluminum bass boat, the motor would preferably provide thrust falling within a range of from approximately 20 lbs. to approximately 50 lbs. and more preferably falling within a range of from approximately 30 lbs. to approximately 35 lbs. For a larger, heavier boat, like a 21 foot fiberglass bass boat, the motor would preferably provide thrust falling within a range of from approximately 50 lbs. to approximately 120 lbs. and more preferably falling within a range of from approximately 70 lbs. to approximately 110 lbs. It is of course understood that any number of different motors may be used and that the motor need not be a DC motor.

A shaft 32 extends through the housing 18, aligned substantially perpendicular to an axis corresponding with the length of the boat 10 and aligned substantially parallel to the transom 22 of the boat. End portions of the shaft 32 extend through end portions of the housing 18, and propellers 34 are secured to the end portions of the shaft 32 to provide thrust in the port or starboard direction, depending upon the direction of rotation. The shaft 32 is operably connected to the electric motor 28 without the need for worm gears, thereby reducing maintenance requirements and extending the life of the equipment. The propellers 34 and electric motor 28 are carefully matched to provide enough thrust for positioning while avoiding providing too much thrust that might tend to cause a person to lose their balance in case the thruster 16 was accidentally activated.

Figure 2:
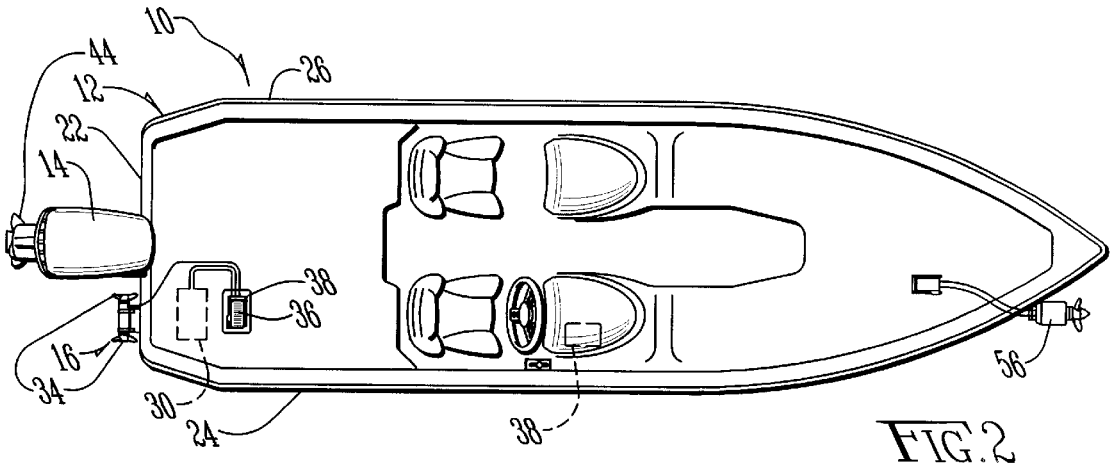
FIG. 2 is an overhead, plan view of a system of the present invention.
Figure 6:
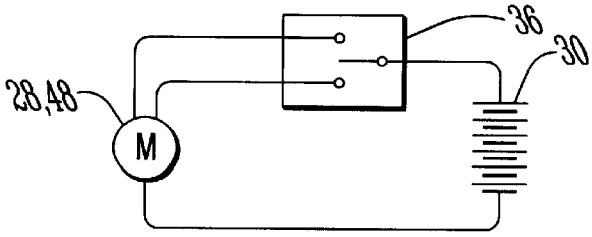
FIG. 6 is a wiring diagram for a switch that may be used in connection with a system of the present invention.

Referring to FIG. 2, a switch 36 is operably connected to the electric motor 28. The switch 36 is preferably a foot switch 36, such as a DPDT center off switch. The switch 36 may be secured in a desired location, such as near the stern for the convenience of the stem fisherman. For greater flexibility, the switch 36 may be movable between any number of places. For example, mating portions of hook and loop type fasteners 38, such as Velcro® brand fasteners, may be affixed to the switch 36 and to various locations on the boat 10. The switch 36 may be manually operated or may be automatic, using any of several known angular sensing systems, including but not limited to magnetic, gyroscopic, or GPS. FIG. 6 depicts a wiring diagram for one embodiment of a DPDT switch 36 that might be used in connection with the present invention. FIG. 6 depicts the most simplistic manual foot switch 36 employing a DPDT momentary, center off, switch facilitating the reversing of polarity necessary to control the rotation direction of the motor 28.

Figure 3:
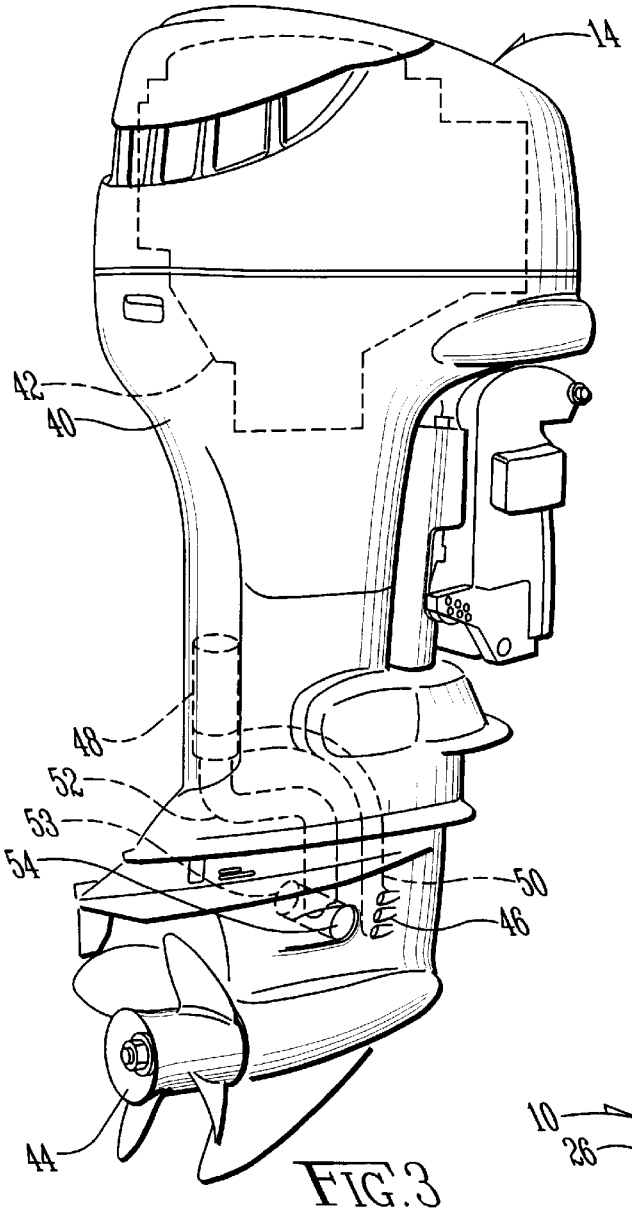
FIG. 3 is a side elevation view of an alternate embodiment of the present invention.

FIG. 3 depicts an alternate embodiment of the present invention. In this embodiment, an outboard motor 14 is equipped to provide the advantages of the present invention. Just as most any conventional outboard motor 14, the outboard motor 14 depicted in FIG. 3 has, among other things, a housing 40, an engine 42 disposed within the housing 40, and a propeller 44 operably connected to the engine. The engine may take any number of forms but will typically be a water cooled, 2 cycle engine or a water cooled, 4 cycle engine. Water intake openings 46 are provided in the housing 40 below the waterline for water intake. A pump 48 is disposed within the housing 40. One or more water intake conduits or lines 50 extend between the intake openings 46 and the pump 48. The pump 48 is preferably a high pressure jet pump operating on the same voltage as the starter motor of the engine 42, such as 12, 24, or 36 vdc. One or more water discharge lines 52 are provided. Water discharge openings 53 and 54 are provided on the starboard and port sides, respectively of the housing 40. Means are provided for selectively directing water from the pump 48 through either opening 53 or opening 54. This may be accomplished in any number of ways, such as by using a vane 55 for selectively directing water from water discharge line 52 through either opening 53 or opening 54. The water discharge line or lines may take any number of different forms, sizes, shapes, and lengths. As used herein the phrase water discharge line includes but is not limited to a pipe, tube, channel, or conduit. Such a discharge line may be disposed within the housing 40, formed as an integral part of the housing 40, or otherwise affixed to the housing 40. It is also understood that a discharge line 52 may extend over substantially the entire length between the water discharge openings 53 and 54 and the pump 48, or it may extend over any shorter length, communicating with a line, channel, conduit, vane, valve or the like that selectively directs water through one of the water discharge openings 53 or 54. Although it is preferred to use a separate system, it is understood that the water intake openings 46, lines 50, pump 48, and discharge openings 53 and 54, or combinations thereof, may be shared with the water cooling system of the outboard motor 14.

Figure 4:
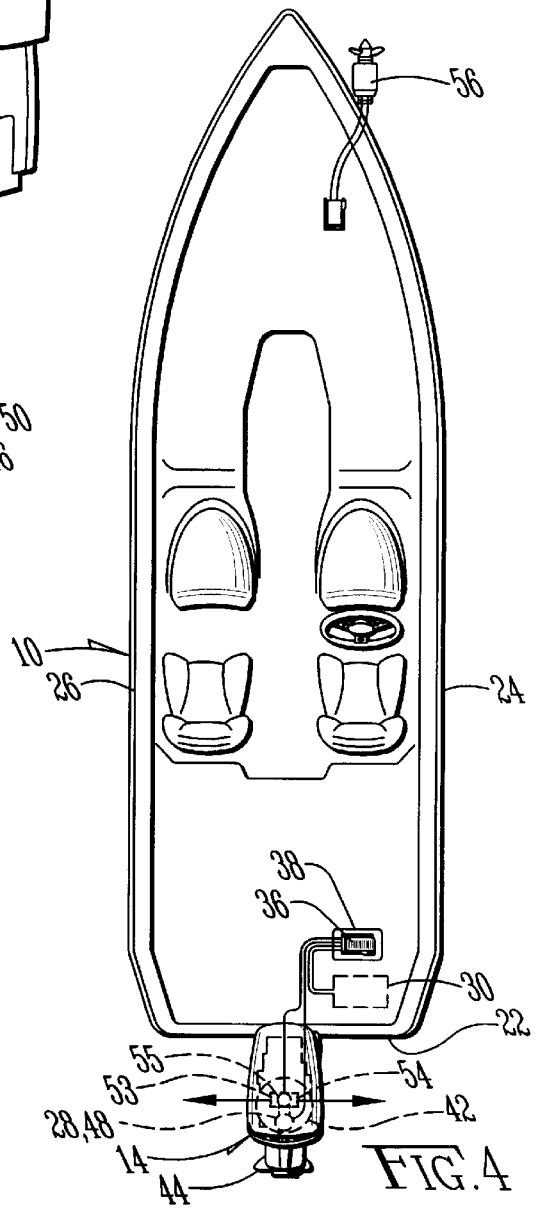
FIG. 4 is an overhead, plan view of an alternate embodiment of the present invention.
Figure 5:
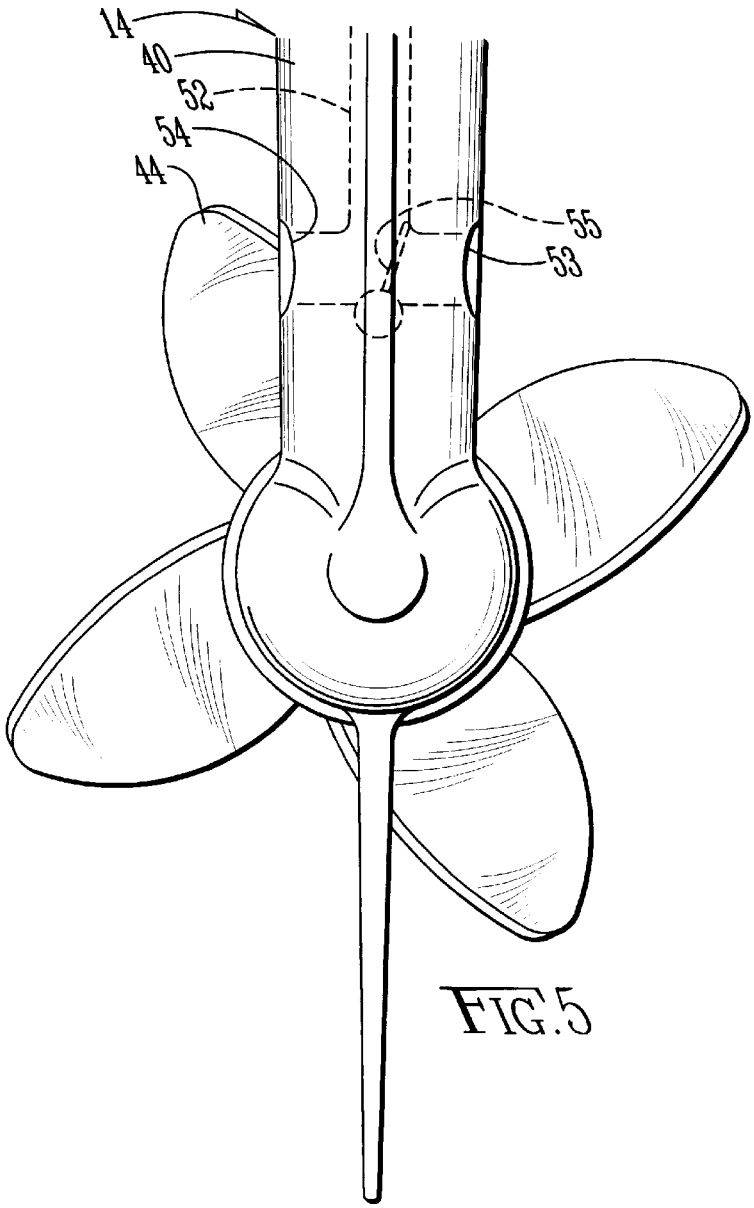
FIG. 5 is a partial, front elevation view of an alternate embodiment of the present invention.

As best seen in FIG. 4, similar to the embodiment described earlier, a switch 36, preferably a foot switch 36, such as a DPDT center off switch, is operably coupled to the pump 48, vane, valve 55, or the like to selectively discharge water from the openings 53 or 54 on the starboard or port side, respectively, of the housing 40. In the preferred embodiment, the propeller 44 rotates about an axis, and the water discharge openings 53 and 54 are disposed to discharge water in a direction that is substantially horizontal and substantially perpendicular to that axis. The switch 36 is preferably substantially similar to the switch 36 described in connection with the earlier embodiment discussed above. Of course any number of different conventional switches may be used, including manual, variable, and automatic switches.

In operation, the switch 36 is positioned in a convenient location in the boat, such as in the stern. If desired, a switch 36 having a portion of a hook and loop fastener 38 may be detached from one location and moved to another, preferably a location with a mating portion of the hook and loop fastener 38. A fisherman or boater initially positions the boat 10 in a desired orientation in the water. When water or wind conditions move the boat 10, typically the stem, to an undesired position, the user moves the switch 36 to activate the electric motor 28 or pump 48 to provide thrust in either the port or starboard direction as desired. The user provides the thrust needed to return the boat 10 to the desired orientation or to move the boat to a newly desired orientation. The user then deactivates the switch 36, such as by releasing it. If automatic controls are used, a user positions the boat 10 in a desired orientation in the water and activates the automatic controls. The sensing system senses deviations from the desired orientation and activates the electric motor 28 or pump 48 as needed to provide thrust in either the port or starboard direction, thereby maintaining the boat 10 in the desired orientation.

Although the system is useful in any number of different situations, it is particularly useful for applications typically encountered when using relatively small, freshwater fishing boats. It is preferably used in connection with a boat 10 having a hull 12 with a length that is not greater than approximately 25 feet and is more preferably used in connection with a boat 10 having a hull 12 with a length that is not greater than approximately 22 feet. These are the types of boats typically used by bass fisherman and the like. Accordingly, these types of boats are more likely to be used in situations in which it is important to maintain a particular orientation near an area to be fished. It is in these situations in which ease of use is also very important and hands free operation is more greatly appreciated. The system works even better when the boat 10 includes a trolling motor 56 movably affixed to the bow of the boat.

Other modifications, changes and substitutions are intended in the foregoing, and in some instances, some features of the invention will be employed without a corresponding use of other features. For example, the thruster 16 may be positioned in any number of different ways on the boat. Also, although a foot switch 36 is preferred, it is understood that any number of different switches or combinations of switches may be used. Further, although it is preferred to use the battery 30 already supplied for operation of the trolling motor and/or outboard motor starter, it is understood that an independent power source may be used. Of course, quantitative information is included by way of example only and is not intended as a limitation as to the scope of the invention. Accordingly, it is appropriate that the invention be construed broadly and in a manner consistent with the scope of the invention disclosed.

What is claimed is:

1. A boat, comprising:

a hull having a transom and having a length not greater than approximately 25 feet;

an outboard motor secured to said transom; and a thruster, said thruster comprising:

a housing having first and second end portions, said housing being secured to said transom to maintain a fixed position relative to said transom, and said housing being disposed above a slip stream that occurs when said boat is on plane;

a reversible, electric motor disposed within said housing;

a shaft having first and second end portions, said shaft being disposed within said housing, and said first and second end portions of said shaft extending outward from said first and second end portions of said housing, said shaft being operably coupled to said reversible, electric motor;

first and second propellers affixed to said first and second end portions of said shaft; and a switch operably connected to said reversible, electric motor.

2. The boat of claim 1, wherein said switch comprises a foot switch.

3. The boat of claim 2, further comprising mating first and second portions of a hook and loop fastener, said first portion of said hook and loop fastener being secured to said foot switch, and said second portion of said hook and loop fastener being affixed to a floor of said boat.

4. The boat of claim 3, further comprising an additional second portion of said hook and loop fastener, said additional second portion of said hook and loop fastener being affixed to said boat and being disposed remotely from said second portion of said hook and loop fastener.

5. The boat of claim 1, further comprising a battery, said outboard motor and said thruster being operably connected to said battery.

6. The boat of claim 1, wherein said reversible, electric motor comprises a fractional horsepower motor.

7. The boat of claim 1, further comprising a trolling motor movably fixed to the bow of said boat.

8. A device, comprising:

a housing having a port side and a starboard side, said housing having a first discharge opening in said port side and a second discharge opening in said starboard side;

an engines disposed within said housing;

a propeller operably connected to said engine;

a pump disposed within said housing;

a water intake line operably connected to said pump;

a water discharge line operably connected to said pump, said water discharge being in communication with said first and second discharge openings; and means for selectively directing water from said water discharge line through either said first discharge opening or said second discharge opening.

9. The device of claim 8 wherein said propeller rotates about an axis and said first discharge opening is disposed to discharge water in a direction that is substantially perpendicular to said axis.

10. The device of claim 9 wherein said first discharge opening is disposed to discharge water in a direction that is substantially horizontal.

11. The device of claim 8, wherein said means for selectively discharging water through either said first discharge opening or said second discharge opening comprises a vane operably connected to said water discharge line.

12. The device of claim 11, further comprising a first portion of a hook and loop fastener, said first portion of said hook and loop fastener being secured to a foot switch.

13. The device of claim 8, wherein said engine comprises a water cooled, 2 cycle engine.

14. The device of claim 8, wherein said engine comprises a water cooled, 4 cycle engine.

15. A boat comprising:

a hull having a transom; and an outboard motor secured to said transom, said outboard motor comprising:

a housing having a port side and a starboard side, said housing having a first discharge opening in said port side and a second discharge opening in said starboard side;

an engine disposed within said housing;

a propeller operably connected to said engine;

a pump disposed within said housing;

a water intake line operably connected to said pump;

a water discharge line operably connected to said pump, said water discharge being in communication with said first and second discharge openings;

means for selectively directing water from said water discharge line through either said first discharge opening or said second discharge opening; and a switch operably connected to said means for selectively directing water through either said first discharge opening or said second discharge opening.

16. The boat of claim 15, wherein said hull has a length not greater than approximately 22 feet.

17. The boat of claim 15, wherein said propeller rotates about an axis and said first discharge opening is disposed to discharge water in a direction that is substantially perpendicular to said axis.

18. The boat of claim 17, wherein said second discharge opening is disposed to discharge water in a direction that is substantially perpendicular to said axis.

19. The boat of claim 15, wherein said switch comprises a foot switch.

20. The boat of claim 19, further comprising mating first and second portions of a hook and loop fastener, said first portion of said hook and loop fastener being secured to said foot switch, and said second portion of said hook and loop fastener being affixed to a floor of said boat.

* * * * *